US008561868B2

(12) United States Patent
Shor

(10) Patent No.: US 8,561,868 B2
(45) Date of Patent: Oct. 22, 2013

(54) DEVICE FOR DRIVING FLEXIBLE STRIPS OF FASTENERS

(75) Inventor: Ilya Shor, Brooklyn, NY (US)

(73) Assignee: Arrow Fastener Co., Inc., Saddle Brook, NJ (US)

( * ) Notice: Subject to any disclaimer, the term of this patent is extended or adjusted under 35 U.S.C. 154(b) by 1123 days.

(21) Appl. No.: 11/923,023

(22) Filed: Oct. 24, 2007

(65) Prior Publication Data

US 2008/0105727 A1 May 8, 2008

Related U.S. Application Data

(60) Provisional application No. 60/856,570, filed on Nov. 3, 2006.

(51) Int. Cl.
*B25C 5/10* (2006.01)

(52) U.S. Cl.
USPC ..... 227/110; 227/147; 227/133; 227/120

(58) Field of Classification Search
USPC ..... 227/110, 120, 133, 147
See application file for complete search history.

(56) References Cited

U.S. PATENT DOCUMENTS

| | | | | | |
|---|---|---|---|---|---|
| 1,041,884 | A | * | 10/1912 | Sasseman | 227/119 |
| 2,056,180 | A | | 10/1936 | Flood | |
| 2,090,831 | A | * | 8/1937 | Burkhardt | 72/409.05 |
| 2,431,548 | A | * | 11/1947 | Ericsson | 227/133 |
| 2,577,012 | A | * | 12/1951 | Hinckley et al. | 72/409.05 |
| 2,653,316 | A | * | 9/1953 | Beckman et al. | 227/86 |
| 2,653,317 | A | * | 9/1953 | Beckman et al. | 227/86 |
| 2,743,445 | A | | 5/1956 | Lerner | |
| 2,862,612 | A | | 12/1958 | Brown | |
| 2,896,210 | A | * | 7/1959 | Rubin | 227/133 |
| 2,946,059 | A | * | 7/1960 | Wandel | 227/136 |
| 2,959,786 | A | | 11/1960 | Peterssen | |
| 2,966,681 | A | * | 1/1961 | Campbell | 227/130 |
| 3,113,317 | A | * | 12/1963 | Carlson Sr. et al. | 227/128 |
| 3,133,714 | A | | 5/1964 | Lerner | |
| 3,319,864 | A | * | 5/1967 | Leonard | 227/76 |
| 3,385,498 | A | | 5/1968 | Downie | |
| 3,476,301 | A | * | 11/1969 | Auston | 227/25 |
| 3,602,414 | A | | 8/1971 | Garfinkel | |
| 3,613,878 | A | * | 10/1971 | Langas et al. | 206/340 |
| 3,672,555 | A | | 6/1972 | Korth | |
| 4,138,076 | A | | 2/1979 | Oagley | |
| 4,478,362 | A | * | 10/1984 | Foslien | 227/19 |
| 4,508,220 | A | | 4/1985 | Pearson | |
| 4,523,695 | A | * | 6/1985 | Braun et al. | 227/8 |
| 4,597,518 | A | | 7/1986 | Paul | |
| 4,716,813 | A | | 1/1988 | Prudencio | |
| 4,930,399 | A | * | 6/1990 | Trevor, Jr. | 89/191.02 |
| 4,951,860 | A | * | 8/1990 | Peters et al. | 227/177.1 |

(Continued)

FOREIGN PATENT DOCUMENTS

| | | |
|---|---|---|
| DE | 10132995 A1 | 7/2001 |
| FR | 2850637 | 2/2003 |
| GB | 2159789 | 12/1985 |

*Primary Examiner* — Lindsay Low

(74) *Attorney, Agent, or Firm* — Brooks Kushman P.C.; Lora Graentzdoerffer

(57) ABSTRACT

An example hammer tacker includes a contact face for contacting a material and a firing mechanism adjacent the contact face. The firing mechanism drives a staple into the material when the contact face is brought into contact with the material. A curved staple guide extends from adjacent the contact face.

16 Claims, 2 Drawing Sheets

(56) References Cited

U.S. PATENT DOCUMENTS

| | | | | | |
|---|---|---|---|---|---|
| 5,150,826 | A | | 9/1992 | Logtens | |
| 5,339,983 | A | * | 8/1994 | Caple | 221/25 |
| 5,416,998 | A | * | 5/1995 | Martel | 42/6 |
| 5,697,541 | A | * | 12/1997 | Burke et al. | 227/109 |
| 5,934,504 | A | * | 8/1999 | Elliott | 221/232 |
| 5,975,401 | A | * | 11/1999 | Fealey | 227/134 |
| 6,012,623 | A | * | 1/2000 | Fealey | 227/134 |
| 6,086,304 | A | | 7/2000 | Hujishima et al. | |
| 6,550,660 | B1 | * | 4/2003 | Chlebowski et al. | 227/133 |
| 6,823,592 | B1 | * | 11/2004 | Rowe | 30/329 |
| 6,966,389 | B1 | * | 11/2005 | Riggs | 173/1 |
| 7,232,050 | B2 | * | 6/2007 | Omli | 227/31 |
| 7,481,346 | B2 | * | 1/2009 | Vanden Berg et al. | 227/147 |
| 2004/0155088 | A1 | | 8/2004 | Smeja et al. | |
| 2007/0164076 | A1 | * | 7/2007 | Vanden Berg et al. | 227/133 |
| 2007/0290022 | A1 | * | 12/2007 | Bruins et al. | 227/147 |
| 2008/0093412 | A1 | * | 4/2008 | Vanden Berg et al. | 227/132 |
| 2008/0173690 | A1 | * | 7/2008 | Lamb | 227/133 |

* cited by examiner

DEVICE FOR DRIVING FLEXIBLE STRIPS OF FASTENERS

CROSS REFERENCE TO RELATED APPLICATIONS

This application claims priority to U.S. Provisional Application No. 60/856,570, which was filed on 3 Nov. 2006.

BACKGROUND OF THE INVENTION

This application relates to flexible strips of fasteners and devices for driving flexible strips of fasteners.

Fasteners are commonly used to join material. Some fasteners, such as rivets, physically deform to hold a position that secures material together. Other fasteners, such as nails, anchor within material to hold the fastener in a securing position. Fastening projects may require a large number of fasteners to adequately fasten or secure the material.

Various tools are used to locate fasteners in positions appropriate for securing material. Where multiple fasteners are required for a particular project, the tools are often loaded with many fasteners at one time. Such tools typically index the fasteners as they are used. That is, as a first fastener ejects from the tool, a second fastener moves into an ejecting position.

One type of fastener is a staple. Staples are commonly used in construction and in office environments. In a construction environment, the staples may be loaded into a pneumatic or an electric staple gun, or a hammer tacker. In an office environment, the staples may be loaded into a handheld stapler. In each case, multiple staples are commonly loaded within the tool. Staples typically load into the tool in rigid strips that include multiple staples. Excessive flex or movement can break the strips or otherwise separate the strip into individual staples, which are often difficult to manipulate and tedious to load.

Staple strips straddle a generally straight guide within the tool. The size of the guide, in part, dictates the staple capacity of the tool. Although lengthening the straight guide increases the tool's staple capacity, tools with the lengthened guides are often too large or awkward for practical use. In the past, flexible fastener packs have been used in some tools, but the placement of the guides for the flexible fastener packs led to awkward tool designs.

SUMMARY

An example hammer tacker includes a contact face for contacting a material and a firing mechanism adjacent the contact face. The firing mechanism drives a staple into the material when the contact face is brought into contact with the material. A curved staple guide extends from adjacent the contact face.

An example hand tool includes a contact face for contacting a material and a firing mechanism adjacent the contact face. The firing mechanism drives a fastener into the material when the contact face is brought into contact with the material. A handle extends from adjacent the contact face, and a curved fastener guide extends from adjacent the contact face. The curved fastener guide is for guiding a flexible fastener pack.

BRIEF DESCRIPTION OF THE DRAWINGS

The various features and advantages of this invention will become apparent to those skilled in the art from the following detailed description of an embodiment of the invention. The drawings that accompany the detailed description can be briefly described as follows.

DETAILED DESCRIPTION OF THE PREFERRED EMBODIMENT

Figure 1:
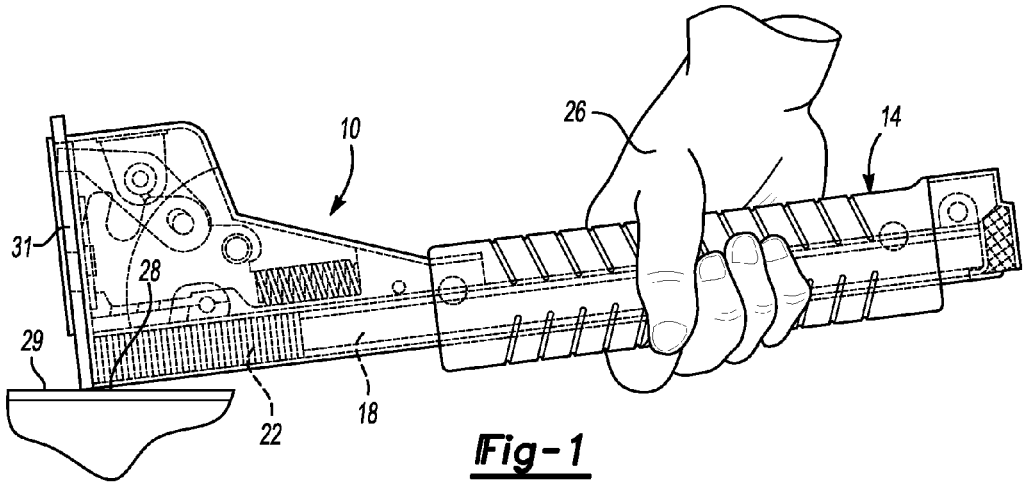
Fig-1 PRIOR ART
FIG. 1 shows a prior art hammer tacker.

FIG. 1 illustrates a prior art hammer tacker 10, a type of tool used for securing staples. The hammer tacker 10 includes a handle 14, and a substantially straight staple guide 18 or rail underneath the handle 14. A ridged staple pack 22 straddles the substantially straight guide 18. Increasing the length of the staple guide 18 increases the staple capacity of the hammer tacker 10. However, increasing the length of the straight staple guide 18 also increases the overall length of the hammer tacker 10.

When using the hammer tacker 10, an operator 26 swings a contact face 28 of the hammer tacker 10 toward a material 29 to be stapled. A carpet pad securable to a subfloor, for example. As known, the hammer tacker 10 includes a firing mechanism 31 that drives staples from the ridged staple pack 22 into the material. The operator 26 drives staples until the material is satisfactorily secured, or until there are no more staples straddling the staple guide 18. If the hammer tacker 10 runs out of staples, the operator 26 must stop stapling and reload another ridged staple pack 22 into the guide 18.

Figure 2A:
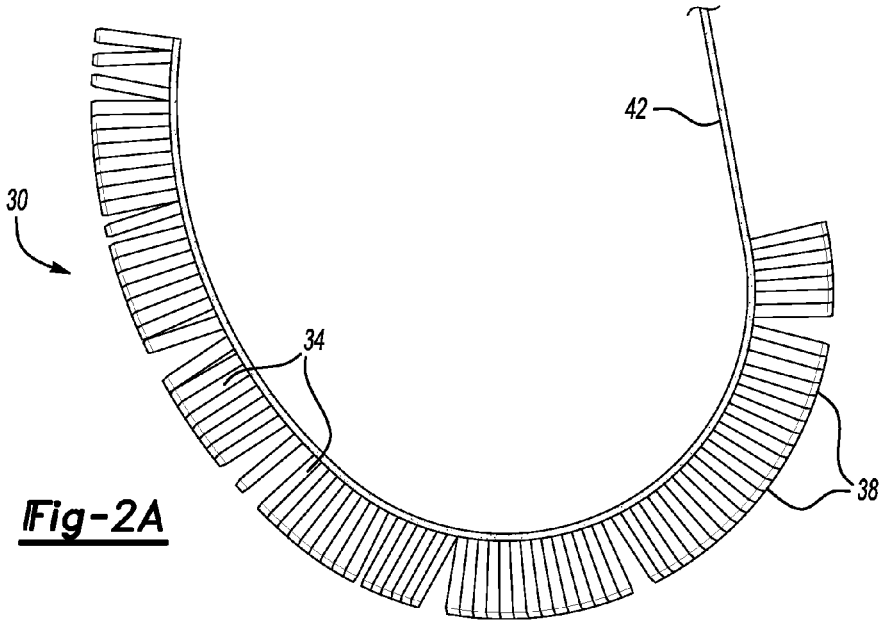
FIGS. 2A and 2B show alternate views of an example flexible staple strip.

FIG. 2A illustrates an example flexible staple pack 30 in a flexed position. The staple pack 30 includes multiple individual staples 34. The staples 34 are typically U-shaped staples each having pronged arms extending to a point 38. The point 38 eases the entry of the staples 34 into a material.

A flexible adhesive 42 joins the staples 34 within the example staple pack 30. In one example, the flexible adhesive 42 is a glue material. In another example, the flexible adhesive 42 is a thin strip of rubber having adhesive properties. The flexible adhesive 42 may also be a melted plastic. The flexible adhesive material 42 holds the individual staples 34 together in position appropriate for loading into a handheld stapler or similar device. Although in this example the flexible adhesive 42 joins the outer portions of the staples 34, the flexible adhesive may also join other portions of the staples 34. For example, the flexible adhesive 42 may adhere to the underside of the staples 34.

Figure 2B:
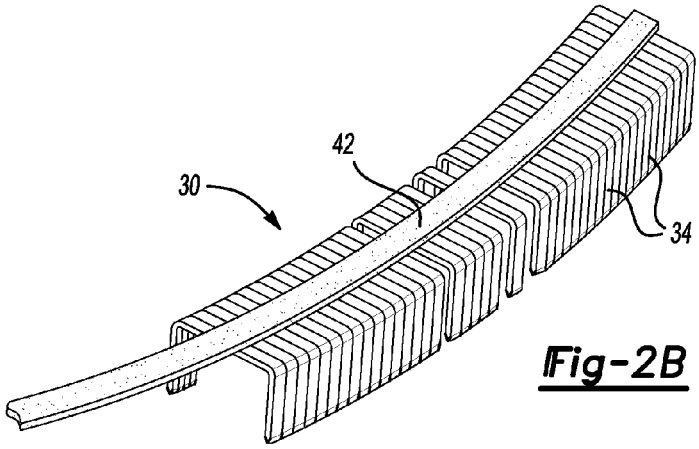

FIG. 2B illustrates an alternate view of the exemplary staple pack 30 in a substantially straightened position. The flexible adhesive 42 holds the staples 34 within the staple pack 30 in position in both the flexed and straightened positions. Moving the staple pack 30 between the flexed position and the straightened position does not disrupt the overall arrangement of the staples 34 relative to each other. Further, moving the staple pack 30 to a flexed position will not break adhesive bond between adjacent staples 34. The flexible adhesive 42 also eases storage of staples 34 as the flexibility of the staple pack 30 prevents breakage of the staple pack 30 if moved during storage.

Although the present invention is shown as using the pack of staples 30 joined by the flexible adhesive 42, those skilled in the art and having the benefit of this disclosure may understand that similar flexible adhesive strips may be used with other types of fasteners, such as nails.

Figure 3:
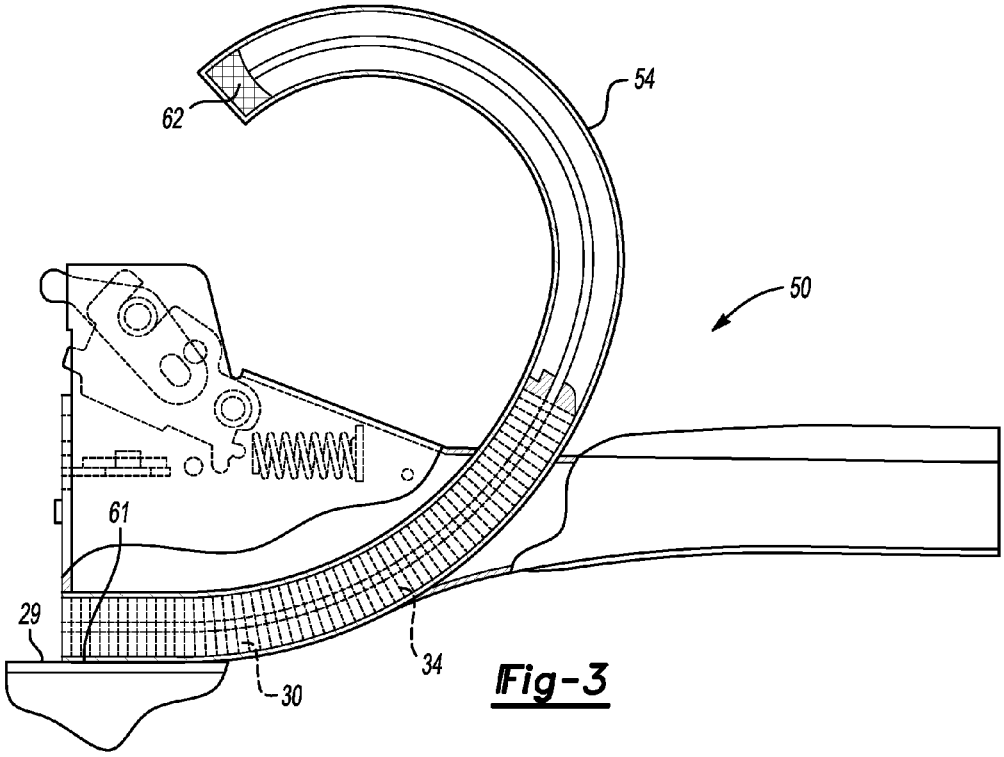
FIG. 3 shows an example hammer tacker having a curved guide and loaded with the flexible staple strip of FIGS. 2A and 2B.

FIG. 3 illustrates an example hammer tacker 50 having a curved staple guide 54 and loaded with the flexible pack 30 of multiple staples 34. The curved guide 54 curves away from the material 29 and a contact face 61 of the hammer tacker 50. In this example, the curved guide 54 increases the staple 34 capacity of the hammer tacker 50 over prior art designs as the curved guide 54 is longer than prior art straight guides, which extended only to the rear edge of the handle 14 (FIG. 1). Increasing the capacity of the hammer tacker 50 increases the amount of staples 34 that can be secured prior to reloading the hammer tacker 50.

The curved guide 54 indexes the staples 34 as the operator uses the hammer tacker 50. A spring loaded pusher 62 may be used to index the staples 34 an appropriate distance within the curved guide 54. Suitable spring loaded pushers are known. The example described herein also extends to other types of devices used to secure staples 34 and other fasteners, for example pneumatic staple guns.

The flexible adhesive 42 expedites loading the staples 34 into a fastening device as multiple staples 34 can be loaded together. Although individual staples could be loaded into the hammer tacker 50, loading multiple staples 34 in the form of the flexible pack 30 speeds the loading process.

The curved staple guide 54 provides greater freedom for the design of the hammer tacker 50. For example, the position of the curved staple guide 54 could be optimized to provide optimum ergonomic advantage to an operator of the hammer tacker 50. Further, although shown as incorporated in a curved staple guide 54, the flexible pack 30 may be incorporated into other guide designs, such as coiled, twisted, or looped guide designs.

Figure 4:
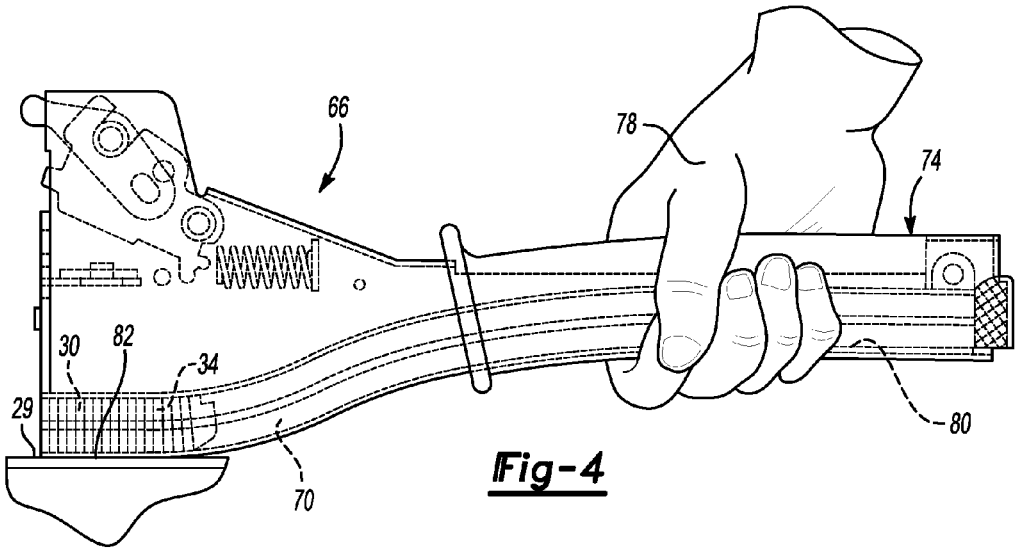
FIG. 4 shows another example hammer tacker having a curved guide and loaded with the example flexible staple strip.

FIG. 4 illustrates another example hammer tacker 66 having a slightly curved staple guide 70. This slightly curved version of the hammer tacker 66 provides improved ergonomics over designs incorporating a straight guide. Further, the curved handle 74 associated with the curved guide 70 provides relief for the fingers of the operator 78. In this example, a lower edge 80 of the curved guide 70 adjacent the fingers of the operator 78 is spaced from a contact face 82 of the hammer tacker 66 such that the operator does not contact the material 29 when the contact face 82 contacts the material 29. The prior art design must rotate approximately 15 degrees away from the material surface to provide the same amount of relief as the hammer tacker 66 incorporating the curved staple guide 70 and curved handle 74.

Although a preferred embodiment of this invention has been disclosed, a worker of ordinary skill in this art may recognize that certain modifications would come within the scope of this invention. For that reason, the following claim should be studied to determine the true scope of coverage of this invention.

I claim:

1. A hammer tacker, comprising:

a contact face for contacting a material;

a firing mechanism adjacent said contact face, said firing mechanism for driving a formed staple into the material when said contact face is brought into contact with the material;

a handle extending from said contact face; and a curved staple guide for guiding a flexible pack of formed staples toward said contact face;

wherein said contact face defines a first plane for contacting the material, and a surface of said curved staple guide on a contact face side of said curved staple guide defines a second plane generally aligned with said first plane, said second plane spaced from said first plane; and wherein a space between said first plane and said second plane provides clearance for an operator grasping said handle when said contact face contacts said material.

2. The hammer tacker of claim 1, wherein said curved staple guide extends from adjacent said contact face and away from said handle.

3. The hammer tacker of claim 1, wherein said curved staple guide extends from a contact face side of said handle past said handle to another side of said handle opposite said contact face side of said handle.

4. The hammer tacker of claim 3, wherein a portion of said curved staple guide extending past said handle to another side of said handle curves toward said firing mechanism.

5. The hammer tacker of claim 1, wherein said curved staple guide curves with said handle.

6. The hammer tacker of claim 1, wherein said handle together with said contact face has a first length, and said curved staple guide has a second length longer than said first length.

7. A hand tool, comprising:

a contact face for contacting a material;

a firing mechanism adjacent said contact face, said firing mechanism for driving a fastener into the material when said contact face is brought into contact with the material;

a handle extending from adjacent said contact face; and a curved fastener guide extending from adjacent said contact face, said curved fastener guide for guiding a flexible fastener pack having a multiple of distinct fasteners adhesively secured relative to each other within the flexible fastener pack;

wherein said contact face defines a first plane for contacting the material and a surface of said curved fastener guide on a contact face side of said curved fastener guide defines a second plane generally aligned with said first plane, said first plane spaced from said second plane; and wherein a space between said first plane and said second plane provides clearance for an operator grasping said handle when said contact face contacts the material.

8. The hand tool of claim 7, wherein said curved fastener guide extends away from said contact face and said handle.

9. The hand tool of claim 7, wherein said curved fastener guide extends from a contact face side of said handle past said handle to another side of said handle opposite said contact face side of said handle.

10. The hand tool of claim 7, wherein a portion of said curved fastener guide extending past said handle to another side of said handle curves toward said firing mechanism.

11. The hand tool of claim 7, wherein said curved fastener guide curves with said handle.

12. The hand tool of claim 7, wherein said handle together with said contact face has a first length, and said curved fastener guide has a second length longer than said first length.

13. The hammer tacker of claim 1, wherein the formed staple is a U-shaped staple.

14. The hammer tacker of claim 1, wherein the flexible pack of formed staples straddles the guide.

15. The hand tool of claim 7, wherein the flexible fastener pack comprises a multiple of U-shaped staples.

16. The hand tool of claim 7, wherein the flexible fastener pack straddles the guide.

* * * * *